US007146675B2

(12) United States Patent
Ansari et al.

(10) Patent No.: US 7,146,675 B2
(45) Date of Patent: Dec. 12, 2006

(54) HANDHELD TOOTHBRUSH

(75) Inventors: Petra Ansari, Eschborn (DE); Conrad Berghammer, Oestrich-Winkel (DE); Andrea Birk, Bad Homburg (DE); Gerhard Finger, Schimitten (DE); Manfred Klawuhn, Frankfurt am Main (DE); Joachim Klimeck, Neu-Anspach (DE); Joachim Wilhelm, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 441 days.

(21) Appl. No.: 10/823,815

(22) Filed: Apr. 14, 2004

(65) Prior Publication Data

US 2005/0011031 A1 Jan. 20, 2005

(30) Foreign Application Priority Data

Jul. 19, 2003 (DE) ..... 103 32 872

(51) Int. Cl.
*A46B 9/04* (2006.01)

(52) U.S. Cl. ..... 15/167.1; 15/DIG. 5; D4/104

(58) Field of Classification Search ..... 15/167.1, 15/DIG. 5; D4/104
See application file for complete search history.

(56) References Cited

U.S. PATENT DOCUMENTS

| | | | | |
|---|---|---|---|---|
| 1,698,128 A | | 1/1929 | Funk | |
| 2,161,349 A | * | 6/1939 | Hadden | 15/167.1 |
| 2,186,005 A | * | 1/1940 | Casto | 15/167.1 |
| 2,305,461 A | * | 12/1942 | Spyra | 15/167.1 |
| 3,295,156 A | | 1/1967 | Brant | |
| D273,635 S | * | 5/1984 | Stocchi | D4/104 |
| 5,392,483 A | | 2/1995 | Heinzelman et al. | |
| 5,446,940 A | * | 9/1995 | Curtis et al. | 15/167.1 |
| 6,308,367 B1 | * | 10/2001 | Beals et al. | 15/167.1 |
| 6,405,401 B1 | * | 6/2002 | Hellerud et al. | 15/167.1 |

FOREIGN PATENT DOCUMENTS

| | | | |
|---|---|---|---|
| DE | 1 935 020 | | 3/1966 |
| DE | 101 22 987 | | 11/2002 |
| JP | 2000-119 | * | 1/2000 |
| JP | 2002-191436 | * | 7/2002 |
| WO | WO97/03587 | | 2/1997 |
| WO | WO 01/43584 | | 6/2001 |
| WO | WO 01/52696 | | 7/2001 |

* cited by examiner

*Primary Examiner*—Mark Spisich
(74) *Attorney, Agent, or Firm*—Fish & Richardson P.C.

(57) ABSTRACT

A handheld toothbrush with a brush head having a forward free end and a rearward portion. Provided at the forward free end of the brush head is at least one bristle tuft of a first set. Adjoining the first set in rearward direction is a second set of tufts comprised of several bristle tufts arranged serially on a ring and extending in the circumferential direction of the ring at an angle of inclination relative to the surface of the brush head. A third set of tufts adjoins the second set of bristle tufts in the direction towards the rearward portion. The tufts of the third set are inclined in the circumferential direction in opposition to the direction of the bristle tufts of the second set. As a result, these tufts are capable of penetrating optimally between the user's teeth, hence ensuring a better cleaning result.

17 Claims, 2 Drawing Sheets

HANDHELD TOOTHBRUSH

CROSS REFERENCE TO RELATED APPLICATION

This application claims priority to German Patent Application No. DE 103 32 872.6, filed Jul. 19, 2003, which is incorporated herein by reference in its entirety.

TECHNICAL FIELD

This invention relates to handheld toothbrushes.

BACKGROUND

In some handheld toothbrushes, tufts of bristles arranged on a ring in the mid-region of the brush head project from the surface close to the brushing side. The tufts extend in opposition to the circumferential direction in an inclined relationship to the surface of the brush head. Disposed radially inside these tufts are further tufts that are arranged on a second ring of smaller diameter and are equally inclined in the same direction as the outer tufts.

It is an object of the present invention to provide a handheld toothbrush in which, during brushing, a maximum possible number of bristle tufts easily penetrate between the teeth and perform a thorough cleaning operation. Preferably, this occurs not only during an up and down movement, but also during a back and forth movement of the handheld toothbrush. Furthermore it is also an object to clean during brushing the sides of the teeth particularly thoroughly.

SUMMARY

The present invention provides a handheld toothbrush which enables thorough cleaning of the interproximal spaces between teeth and their sides. This is accomplished by arranging the outer bristle tufts of a second set of bristle tufts, disposed on a ring, in an inclined position in opposition to the bristle tufts of a third set and separating the two sets locally in a longitudinal direction. This arrangement enables particularly good penetration between the user's teeth by those bristle tufts that are inclined in the direction of movement of the handheld toothbrush, while the bristle tufts that are inclined in opposition to the direction of movement of the handheld toothbrush more or less clean the surface of the tooth sides. When the toothbrush is moved in the other direction, the oppositely directed bristle tufts engage better between the teeth, yet from the other side, so that they are in a position to better clean the interproximal spaces from the other side.

When the handheld toothbrush is moved back and forth, those bristle tufts on the rings make particularly effective brushing engagement with the teeth as are disposed more or less in the edge region of the brush head. This is so because, on the side edges, individual tufts extend in the direction of movement of the handheld toothbrush, striking the interproximal spaces and the tooth surface transversely from above—similar to a scraper—thus particularly effectively removing plaque from the tooth surface.

The bristle tufts, inclined in a direction transverse to the back and forth movement of the handheld toothbrush, are arranged more or less in the inner region of the brush head. They extend in a direction transverse to the direction of movement of the toothbrush, thus producing a sliding effect on the end faces of the teeth which are easily accessible from the side.

When the toothbrush is moved up and down, that is, essentially parallel to the interproximal spaces, the scraping and sliding cleaning function in the interproximal spaces is performed by the bristle tufts arranged in the mid-region of the brush head on the outer ring. Thus, a better cleaning operation is accomplished in the interproximal spaces and also on the end faces of the teeth in a shorter period of time. During this up and down movement, the bristle tufts provided on the outer edge perform a sweeping movement directed at cleaning the surface of the tooth sides, because these tufts do not reach between the user's teeth as easily. Accordingly, the toothbrush of the invention cleans the interproximal spaces within a shorter time than is the case with prior-art devices.

Another benefit is that a first set of bristle tufts provided at the forward free end of the brush head services the rearmost molar region because this set is in the foremost position when the brush head enters an oral cavity.

The cleaning action performed by the outer bristle tufts provided on a ring is preferably aided by further bristle tufts supporting the outer bristle tufts from within as the bristles are pressed against the tooth surface, thus enabling them to better penetrate the interproximal areas and better clean the end faces. At the same time and additionally, the further bristle tufts are in a position to better clean the front surfaces of the teeth so that it is not necessary for the outer bristle tufts to perform the cleaning work alone. This has the added effect of extending the useful life of the handheld toothbrush.

By fanning out the free ends of the bristle tufts, a continuous surface of the bristle tufts of the second and third sets can be obtained to enable a still further improved cleaning operation on the user's tooth surfaces. Owing to the nearly continuous surface of the inner bristle tufts arranged within the rings of the outer bristle tufts, a particularly large area of the tooth surface is cleaned. Consequently, even in the presence of an increased application pressure, the bristles do not quickly bend away to the sides which would be of little advantage for the cleaning result and the durability. Furthermore, toothpaste is capable of adhering better to the continuous surface and cannot run down along the bristle tufts.

Similarly, a particularly uniformly roughened, continuous cleaning surface can be achieved on the free ends of the inner bristle tufts. In this arrangement, the fine fiber structure has the effect of causing interlacing of the free ends of the individual bristles of the tufts so as make them indistinguishable. The bristles of all the inner tufts form a joint tuft having just one common working surface that is capable of cleaning a large area of the tooth surface. In this arrangement, the fanning out of the bristle tufts can be performed by means of a rapidly rotating disk having on its surface small blades extending perpendicularly to the disk. The blades operate to break up the working ends of the inner bristle tufts and to fan them out in such manner that their fine fibers become interlaced, thereby producing a continuous, yet roughened, surface.

Particularly good cleaning results are obtained when the bristle tufts of the second and third sets located on the rings are inclined at an angle of inclination relative to the surface of the brush head. Owing to the small angle of inclination, the individual bristle tufts exert some resistance when pressed against the tooth surface, thus enabling a user's hand to deliver a maximum possible amount of application pressure onto the tooth surfaces. This increases the effectiveness of a toothbrush, producing a better cleaning result in a shorter period of time. The angle of inclination is preferably between about 5° and about 12° and, more preferably, between about 7.5° and 8.5°.

The bristle tufts located on the rings can be selected to have a first common length that is greater than a second common length of the further bristle tufts lying within the rings. This results in a soft and elastic working surface of the handheld toothbrush. Consequently, in the presence of a low application pressure, the bristle tufts formed on the ring make an initial engagement with the tooth surfaces, and when the application pressure on the tooth surface is increased, the tufts that have not entered an interproximal space bend to an extent causing the other, shorter tufts to be put to use. The user becomes aware of this condition as the handheld toothbrush becomes harder as pressure continues to be applied. It is then necessary for the application pressure on the handheld toothbrush to be significantly increased when it is desired to bend or deform all the bristle tufts on the brush head to accomplish a thorough cleaning operation. This tuft array improves the handling of the handheld toothbrush because the user receives a better feedback enabling him to react promptly to a higher or lower pressure.

In addition, a fourth set of bristle tufts can be added extending transversely to the longitudinal direction of the brush head so that the fourth set adjoins each of the first, second and third sets of bristle tufts. The fourth set of bristle tufts, arranged between the second and third set of bristle tufts, supports the tufts of the second and third set during their brushing movements in small fringe regions in the sense of reinforcing the sides, that is, in addition to their own brushing function they contribute to increasing the flexural resistance of these bristle sets. This provides for greater durability of the handheld toothbrush of the invention. This effect is further enhanced when the bristle tufts of the fourth set are comprised of spaced apart bristle tufts in a side-by-side array with a greater hardness than the individual bristle tufts of the first, second, and third sets, so that overall the wear of the bristle tufts of the handheld toothbrush is further reduced.

Wear can be reduced still further by arranging the bristle tufts of the fourth set level with the bristle tufts lying within the bristle tufts provided on a ring. The bristle tufts are put to use simultaneously, thus causing hardening of the working surface of the tufts. However, they can also be longer than the bristle tufts lying within the bristle tufts provided on the ring, while being shorter than the bristle tufts provided on the ring. Thus, the tufts are put to use with a slight delay, yet still contribute to hardening the working surface of the tufts adequately. They also have a supporting effect on the tufts of the first to third set provided between these tufts.

The bristle tufts of the fourth set can also be arranged to protrude upwardly substantially vertically from the surface of the brush head thus effecting a supporting action for the bristle tufts of the second set lying closest to these bristle tufts. By virtue of the vertical arrangement of the bristle tufts of the fourth set, these can be arranged on the brush head in such manner that they are particularly close to the bristle tufts provided on the ring so that the supporting effect is obtained right at the beginning of the cleaning operation.

When the frontal bristle tuft of the first set is inclined towards the forward end at an angle relative to the vertical on the surface of the brush head, the handheld toothbrush of the invention provides superior cleaning because the forward area of the brush head reaches deeper into the molar region. This also enables the rearmost region of the molars to be better cleaned. The first set can also be comprised of six bristle tufts whose free ends terminate on a common plane inclined at an angle relative to the surface, and that the first plane extends above a second plane formed by the free ends of the second and third sets of bristle tufts. With such a toothbrush held in conventional manner, this feature ensures that the working end of the first set of bristle tufts, which has its plane inclined, makes relatively snug engagement with the tooth surface to be cleaned, thus performing a uniform cleaning function of the molar surface without requiring a constant change in application pressure.

The handheld toothbrush can use bristle tufts of an essentially circular configuration. The cross sections of the bristle tufts can be essentially equal. This affords particular ease of manufacture, in that the tufts are of like cross section but yet of different bristle strength and bristle color. These features enable the tooling required for such a handheld toothbrush to be manufactured with greater ease so that the manufacturing cost of the handheld toothbrush can be reduced.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
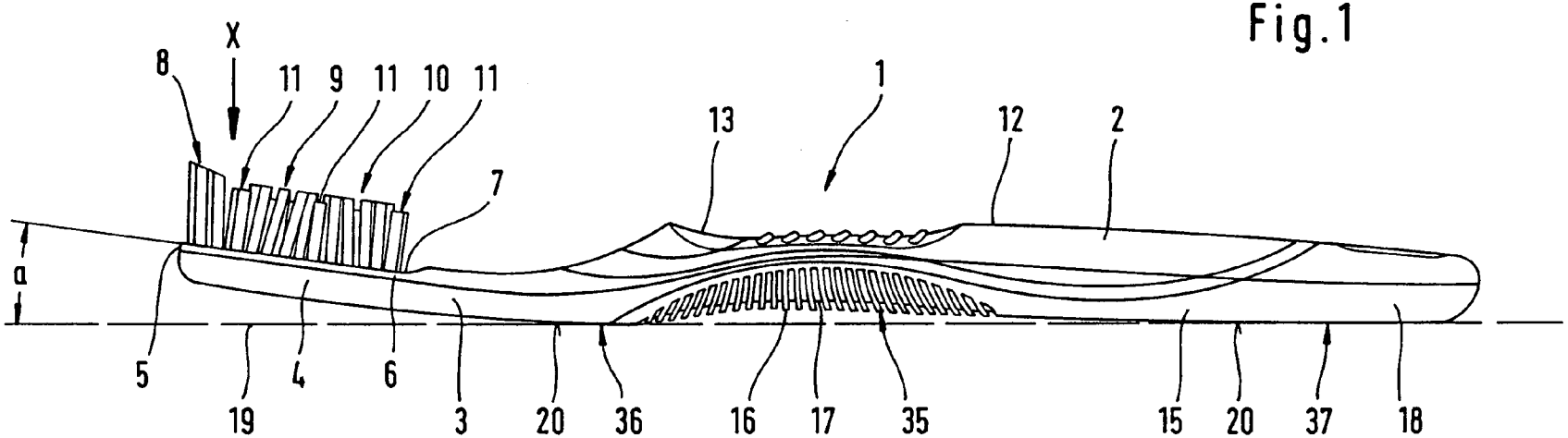
FIG. 1 is a side view of a handheld toothbrush equipped with the bristle sets of the present invention.
Figure 2:
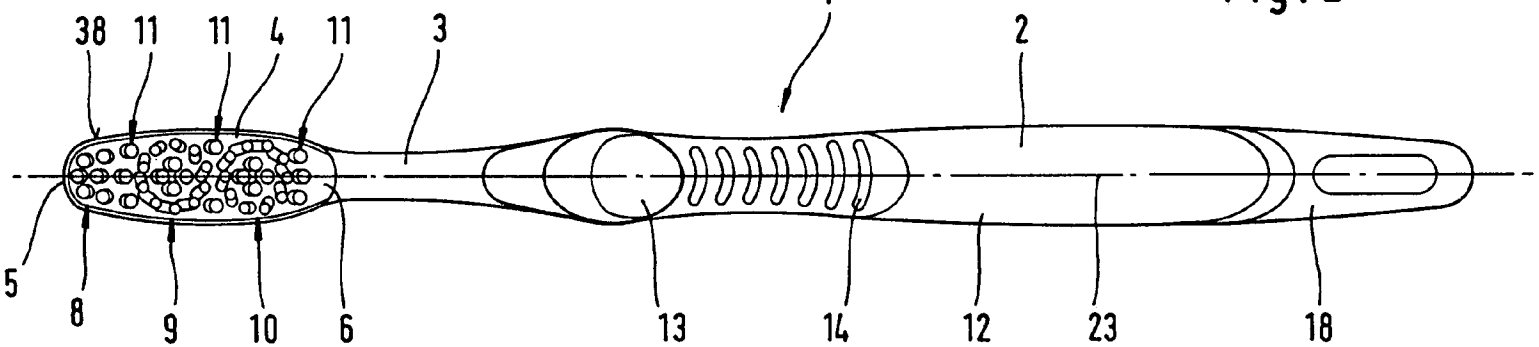
FIG. 2 is a top plan view of the handheld toothbrush of FIG. 1, taken in the direction of arrow X.
Figure 3:
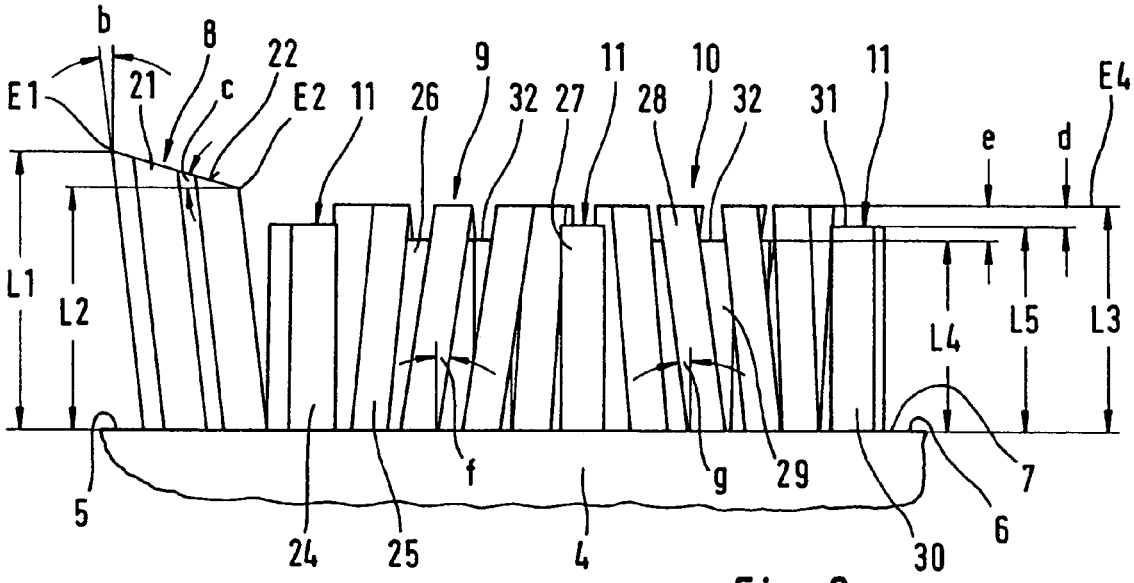
FIG. 3 is a partial side view of the brush head showing the complete bristle sets of FIG. 1, yet on an enlarged scale.
Figure 4:
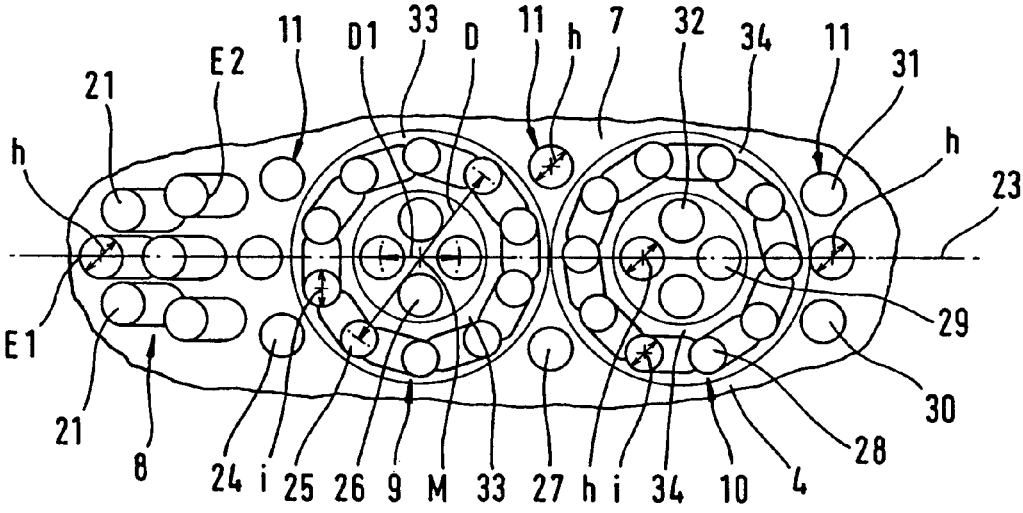
FIG. 4 is a partial top plan view of the brush head showing the complete bristle sets of FIG. 3.

FIGS. 1 and 2 show a handheld toothbrush 1 that is comprised of an elongated handle 2, a neck 3 of reduced cross section which adjoins the handle 3, and a brush head 4 adjoining the neck 3. The brush head 4 has a forward end 5 and a rearward end 6 between which four sets 8 to 11 of bristle tufts 21 and 24 to 30 extend upwardly from the surface 7 (FIG. 1), as also illustrated in FIGS. 3 and 4 on an enlarged scale. Provided on the upper side 12 of the handle 2 is a grip area 13 suitable for engagement with a user's thumb, the grip area slightly recessed within the surface 12 and including raised ribs 14 that extend from the end close to the rearward free end in a direction transverse to the handle 2, are made from a thermoplastic elastomer material and bent slightly forwardly in the direction of the brush head 4.

Referring now to FIG. 1, a further grip area 35 is provided on the lower side 15 of the handle 2 level with the grip area 13. The further grip area 35 is formed by lamella-type ribs 16 extending in a direction transverse to the longitudinal axis of the handheld toothbrush 1, said ribs being very narrow and accordingly of a yielding configuration similar to a cushion when individual fingers are pressed against them. The fine ribs 16 and the substrate 17 interconnecting the ribs 16 are equally fabricated from a thermoplastic elastomer material that is injection molded onto the body 18 of the handle 2 and provided only in the forward and side regions of the handle 2.

As shown in FIGS. 1, 2, and 3, the handheld toothbrush 1 is of a symmetrical configuration having an axis of symmetry or center axis 23 that extends in the longitudinal direction of the handheld toothbrush 1. As seen in top plan view, the brush head 4 has the shape of an elongated oval having ends with a pronounced curvature, which form the forward and rearward ends 5 and 6, respectively. The surface 7 of the brush head 4 from which the four sets 8 to 11 of bristle tufts 21 and 24 to 30 project extends at an upward inclination, forming an angle a with a depository area 19. The depository area 19 can be any surface of a piece of furniture. When the handheld toothbrush 1 is placed down on this depository area 19 as shown in FIG. 1, some of its bearing areas 36, 37 provided on its lower side 20 take support on the depository area 19, causing the toothbrush 1 to occupy a stable position in which the upper side 12 points substantially vertically upwardly, as shown in FIG. 1. The included angle a defined between the depository area 19 and the surface 7 is between 2° and 6°, preferably 4°. With such an angle a, the handling of the handheld toothbrush 1 is particularly good because it does not require a user's hand to be turned for the sets 8 to 11 of the bristle tufts 21 and 24 to 30 to engage against the user's tooth surfaces (not shown) relatively vertically.

According to FIGS. 1 to 4, adjacent to the forward end 5 is a first set 8 of bristle tufts 21 that is inclined toward the forward end, forming an angle b with the vertical on the surface 7. The angle b is between 5° and 9°, preferably 7°. The free ends 22 of the bristle tufts 21 form a common plane sloping upwardly at an angle c relative to the surface 7. The angle c is between 13° and 18°, preferably about 15°. The foremost point E1 of the foremost bristle tuft 21 is at a distance L1 of about 12 mm to the surface 7. The rearmost point E2 of the two rearmost bristle tufts 21 is at a distance L2 of 10.5 mm to the surface 7. The bristle tufts 21 of the first set protrude from the surface 7 so that they all combine to outline an essentially crescent-shaped cross section according to the top plan views of FIGS. 2 and 4. The first set 8 is formed by six bristle tufts 21 of which five tufts 21 extend parallel to the edge 38 and one tuft 21 is located within the five tufts 21, so that this set 8, when viewed from end-on, appears in an essentially crescent-shaped configuration.

Adjoining the first set 8 of bristle tufts 21 is a portion of a fourth set 11 of bristle tufts 24 extending in a direction transverse to the center axis 23 of the handheld toothbrush 1, as shown in FIGS. 2 and 4. The portion of fourth set 11 is comprised of three tufts 24 essentially equidistantly spaced from the closest neighboring tufts 21 of the first set 8. Accordingly, they lie on an arc of a circle and extend symmetrically to the center axis 23, with the middle tuft 24 being centrally located directly on the center axis 23.

According to FIGS. 1 to 4, the portion of fourth set 11 of bristle tufts 24 is adjoined by a second set 9 of bristle tufts 25 equidistantly spaced apart on a diameter D and inclined anticlockwise at an angle f to the surface 7, as shown in FIG. 2. The angle f amounts to between 6° and 8°, preferably about 7°, while the diameter D is between 7 and 10 mm, preferably about 8.5 mm. The bristle tufts 25 are diametrically opposed to one another and comprised of eight to fourteen, preferably ten, tufts 25. Four further tufts 26 extend from the surface 7 from radially within the second set 9. These further tufts 26 are likewise diametrically opposed to one another and have their center in the same central point M as is the case for the tufts 25. The tufts 26 extend vertically upwardly from the surface 7. They lie on a common diameter D1 and are spaced apart by 90°, with two bristle tufts 26 extending centrally to the center axis 23.

Next to this second set 9 is another portion of fourth set 11 of two tufts 27 that located transversely to the center axis 23, are equidistantly spaced from the center axis 23 and project vertically upwardly from the surface 7.

Adjacent to the bristle tufts 27 is a third set 10 of bristle tufts 28, which is likewise comprised of ten tufts 28 equally spaced apart circumferentially. Unlike the tufts 25 which are inclined anticlockwise, the tufts 28 are inclined clockwise circumferentially at an angle g having the same inclination of 6° to 8°, preferably 7°, as previously indicated for the angle f of the second set 9. Radially disposed within the tufts 28 are again four further tufts 29 protruding vertically upwardly from the surface 7. Greater details regarding the third set 10 are omitted because, with the exception of the opposite direction of inclination, the bristle tufts 28, 29 and their arrangement on the brush head 4 have the same dimensions as previously indicated for the second set 9.

Adjoining the third set 10 is again a portion of fourth set 11 of three tufts 30, wherein the middle tuft 30 is located on the center axis 23. The two outer tufts 30 are equidistantly spaced from the center axis 23.

As shown in FIGS. 1 and 3, the tufts 21 of the first set 8 project farthest in upward direction. However, the tufts 25 and 28 combine to form a common plane E4 (FIG. 3) that extends parallel to the surface 7. The relative distance L3 of the surface 7 to the plane E4 amounts to between 9 and 11 mm, preferably 10 mm. The relative distance d of the plane E4 to the free ends 31 of the tufts 30, 27, 24 of the portion of fourth set 11 is equal, amounting to between 0.7 and 1.1 mm, preferably 0.9 mm. The relative distance e of the plane E4 to the free end 32 of the bristle tufts 29 and 26 amounts to between 1.2 and 1.8 mm, preferably 1.5 mm. While the tufts 25 and 28 have a diameter i of 1.6 mm, the diameters h of the remaining tufts 21, 24, 26, 27, 29 and 30 amount to about 1.9 mm. The free ends 31, 32 of the tufts 30, 27, 24 and 29 and 26 extend equally parallel to the surface 7.

As shown in FIG. 4, the bristle tufts 25 and 28 lie on imaginary rings 33 and 34, respectively, shown as thin lines in FIG. 4. The inner and outer diameters of the rings 33, 34 touch in the worst case the side walls of the tufts 25 and 28, respectively. Otherwise, a distance can still be maintained between the edge of the tufts 25 and 28 and, respectively, the inner and outer diameter of the rings 33, 34. It is, however also possible for a bristle tuft 25 and 28 to be disposed closer to the inner radius or closer to the outer radius of the ring 33 and 34, respectively.

The tufts 26 and 29 disposed within the tufts 25 and 28, respectively, are in such close proximity to each other that their free ends 32, in fanned out condition, form a nearly continuous surface which is, however, not shown in FIGS. 2 and 4 for better clarity of illustration of the basic cross section of the bristle tufts 26, 29.

The bristle tufts 24, 27, 30 of the fourth set 11 have a longitudinal dimension L5 extending from the surface 7 up to their free ends 31. The bristle tufts 26, 29 have a longitudinal dimension L4 extending from the surface 7 up to their free ends 32. Length L4 is shorter than length L5, which in turn is shorter than length L3. Dimension L4 is obtained from L3 minus e, dimension L5 from L3 minus d. A number of embodiments of the invention have been described. Nevertheless, it will be understood that various modifications may be made without departing from the spirit and scope of the invention. Accordingly, other embodiments are within the scope of the following claims.

What is claimed is:

1. A handheld toothbrush comprising a brush head and an adjoining handle, wherein the brush head includes:

a first set of bristle tufts arranged near a forward free end of the brush head and comprising at least one bristle tuft extending away from a bristled surface of the brush head;

a second set of bristle tufts immediately rearward of the first set, the second set comprising several bristle tufts protruding from the bristled surface, arranged serially on a ring, and extending in a circumferential direction of the ring at an angle of inclination relative to the bristled surface, the second set further comprising at least one further tuft protruding from the bristled surface and extending within the bristle tufts arranged on the ring; and a third set of bristle tufts immediately rearward of the second set, the third set comprising several bristle tufts which protrude from the surface and are arranged serially on a ring, the bristle tufts of the third set inclined in a circumferential direction in opposition to the inclination of the bristle tufts of the second set.

2. The handheld toothbrush of claim 1, wherein the third set further comprises at least one further tuft that extends within the tufts disposed on the ring of the third set.

3. The handheld toothbrush of claim 2, wherein the bristle tufts of the second and third sets located on the rings have a first common length that is greater than a second common length of the further bristle tufts lying within the rings.

4. The handheld toothbrush of claim 1, wherein the respective working ends of the bristle tufts of the second and third sets disposed within the rings form a nearly continuous surface.

5. The handheld toothbrush of claim 4, wherein the continuous surface of the bristle tufts of the second and third sets is obtained by fanning out the free ends of the bristle tufts.

6. The handheld toothbrush of claim 1, wherein the bristle tufts of the second and third sets located on the rings are inclined at similar angles of inclination relative to the surface of the brush head.

7. The handheld toothbrush of claim 6, wherein the angle of inclination of each bristle tuft on the rings of the second and third sets is between about 5 and 12 degrees.

8. The handheld toothbrush of claim 7, wherein the angle of inclination is between about 7.5 and 8.5 degrees.

9. The handheld toothbrush of claims 1, wherein a respective fourth set of bristle tufts extending transversely to the longitudinal direction of the brush head adjoins each of the first, second and third sets of bristle tufts.

10. The handheld toothbrush of claim 9, wherein the bristle tufts of the fourth set are comprised of spaced apart bristle tufts in a side-by-side array, the spaced apart bristle tufts having a greater hardness than the bristle tufts of the first, second, and third sets.

11. The handheld toothbrush of claim 10, wherein the third set further comprises at least one further tuft that extends within the tufts disposed on the ring of the third set and the bristle tufts of the second and third sets located on the rings have a first common length that is greater than a second common length of the further bristle tufts lying within the rings.

12. The handheld toothbrush of claim 11, wherein the bristle tufts of the fourth set have a third common dimension of length between the first common length and the second common length.

13. The handheld toothbrush of claim 12, wherein the bristle tufts of the fourth set protrude upwardly substantially vertically from the surface of the brush head.

14. The handheld toothbrush of claim 1, wherein a forward bristle tuft of the first set is inclined towards the free forward end of the brush head, extending at a non-perpendicular angle relative to the surface of the brush head.

15. The handheld toothbrush of claim 14, wherein the first set is comprised of six bristle tufts whose free ends terminate on a common plane inclined at an angle relative to the surface of the brush head, the common plane extending above a second plane formed by the free ends of the second and third sets of bristle tufts.

16. The handheld toothbrush of claim 15, wherein individual bristle tufts are of an essentially circular cross-section.

17. The handheld toothbrush of claim 16, wherein cross sections of bristle tufts disposed on the rings of the second and third sets are essentially of a first area and cross-sections of other bristle tufts are essentially of a second area, wherein the second area is greater than the first area.

* * * * *

UNITED STATES PATENT AND TRADEMARK OFFICE

CERTIFICATE OF CORRECTION

PATENT NO. : 7,146,675 B2
APPLICATION NO. : 10/823815
DATED : December 12, 2006
INVENTOR(S) : Petra Ansari et al.

It is certified that error appears in the above-identified patent and that said Letters Patent is hereby corrected as shown below:

Title Page, Column 1, Inventors: item (75);

Delete "Andrea" and insert --Andreas--

Signed and Sealed this

Fourth Day of December, 2007

JON W. DUDAS
*Director of the United States Patent and Trademark Office*